United States Patent [19]

Leonardi

[11] Patent Number: 4,590,692

[45] Date of Patent: May 27, 1986

[54] REAR ENTRANCE SKI BOOT STRUCTURE WITH CONSTANT FLEX

[75] Inventor: Alfio Leonardi, Rome, Italy

[73] Assignee: Nordica S.p.A., Montebelluna, Italy

[21] Appl. No.: 631,362

[22] Filed: Jul. 16, 1984

[30] Foreign Application Priority Data

Jul. 21, 1983 [IT] Italy ..... 22448/83[U]

[51] Int. Cl.[4] ..... A43B 5/04

[52] U.S. Cl. ..... 36/120; 16/295

[58] Field of Search ..... 36/117-121, 36/105; 16/295

[56] References Cited

U.S. PATENT DOCUMENTS

| | | | |
|---|---|---|---|
| 495,965 | 4/1893 | Ennis | 16/295 |
| 2,235,984 | 3/1941 | Devereaux | 16/295 |
| 2,557,048 | 6/1951 | Haase | 16/295 X |
| 4,173,084 | 11/1979 | Kirsch | 37/121 |

FOREIGN PATENT DOCUMENTS

| | | | |
|---|---|---|---|
| 906546 | 3/1954 | Fed. Rep. of Germany | 16/295 |
| 1963342 | 6/1971 | Fed. Rep. of Germany | 36/120 |
| 1817970 | 4/1976 | Fed. Rep. of Germany | 36/120 |

*Primary Examiner*—James Kee Chi

*Attorney, Agent, or Firm*—Guido Modiano; Albert Josif

[57] ABSTRACT

The invention is concerned with a rear entrance ski boot with constant flex, peculiarly comprising a front quarter hingedly connected to a boot shell about an axis lying substantially horizontal and perpendicular to the longitudinal direction of the shell and extending through a front upper region of the shell. Also provided are elastic bias means for resisting forward oscillation of the quarter relative to the shell.

6 Claims, 4 Drawing Figures

REAR ENTRANCE SKI BOOT STRUCTURE WITH CONSTANT FLEX

BACKGROUND OF THE INVENTION

This invention relates to a rear entrance ski boot structure with constant flex.

As is known, current ski boot constructions generally include a shell whereto a front quarter and rear quarter are hingedly attached.

The hinge connection of said quarters is generally provided at two points laterally on the shell, so as to allow for a limited pivotal movement of the quarters relatively to the shell while skiing.

Flex, when viewed as resistance to oscillation of the quarter relatively to the shell, is currently determined by the greater or lesser frictional resistance which is set up between the shell and front quarter which, in its pivotal movement, rubs against the shell.

That frictional resistance is not constant, because it is deeply affected by the environmental conditions, such as temperature, and amount of wear of the contacting parts, so that a constant flex cannot be provided in most cases.

SUMMARY OF THE INVENTION

It is a primary object of this invention to obviate such prior shortcomings by providing a ski boot structure, of the rear entrance type, which affords nearly constant flex features, i.e. a flex unaffected by external factors.

A further object of the invention is to provide a ski boot the flex whereof can be changed by the user with the certainty that the flex setting is unaffected by the wear of the boot parts or variations in the outside temperature.

It is another object of this invention to provide a rear entrance ski boot structure which, owing to its peculiar construction, can make putting the boot on a much easier operation, since the quarters can be opened relatively to the shell to favor introduction of the skier's foot.

These and other objects, such as will be apparent hereinafter, are achieved by a rear entrance ski boot structure with constant flex, according to the invention, characterized in that it comprises a front quarter hingedly connected to a boot shell about a substantially horizontal axis extending perpendicularly to the longitudinal direction of said shell through a front upper region of said shell, also provided being elastic means effective to resist forward oscillation of said front quarter relatively to said shell.

DESCRIPTION OF THE PREFERRED EMBODIMENTS

Further features and advantages will be more clearly understood from the following detailed description of a rear entrance ski boot structure with constant flex, according to the invention, as illustrated by way of example and not of limitation in the accompanying drawing, where:

DESCRIPTION OF THE PREFERRED EMBODIMENTS

Figure 1:
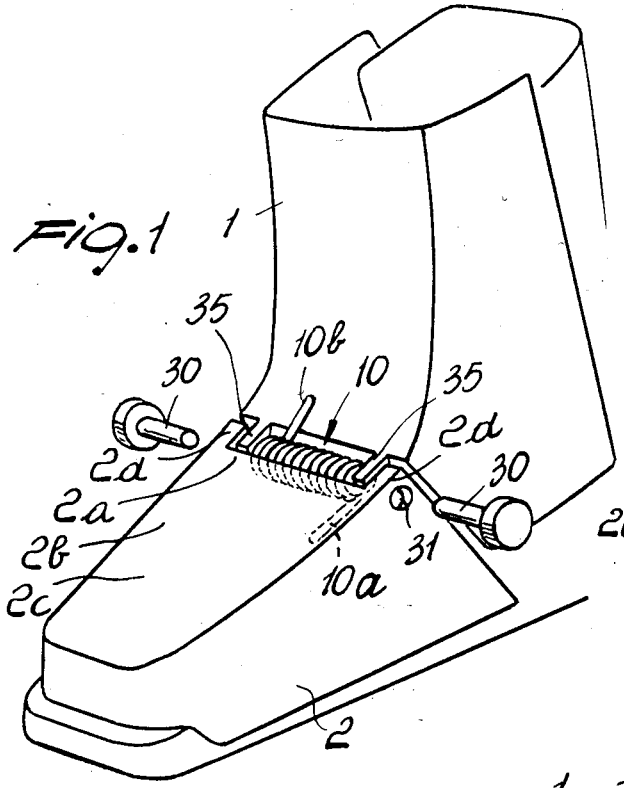
FIG. 1 shows diagrammatically the ski boot structure of this invention.

Making reference to the drawing views, a rear entrance ski boot structure with constant flex, according to the invention, comprises a front quarter 1 which is connected to a boot shell 2 whereto a conventional rear quarter 3 is then hinged. As visiblle in the drawing the front quarter 3 is a separate component part of the ski boot structure.

The peculiar aspect of the invention is that said front quarter 1 is hinged to the shell about a pivot axis located at the shell front upper region and extending through a widthwise recess **2*a* provided in an end portion 2*b* of the front upper region 2*c* of the shell 2, the recess 2*a* defining lug formations 2*d* at opposite sides of the shell 2, as clearly shown in FIG. 1**.

In order to impart a desired degree of flex to the boot, elastic means are provided to resist forward oscillation of the front quarter relatively to the shell 2.

Figure 4:
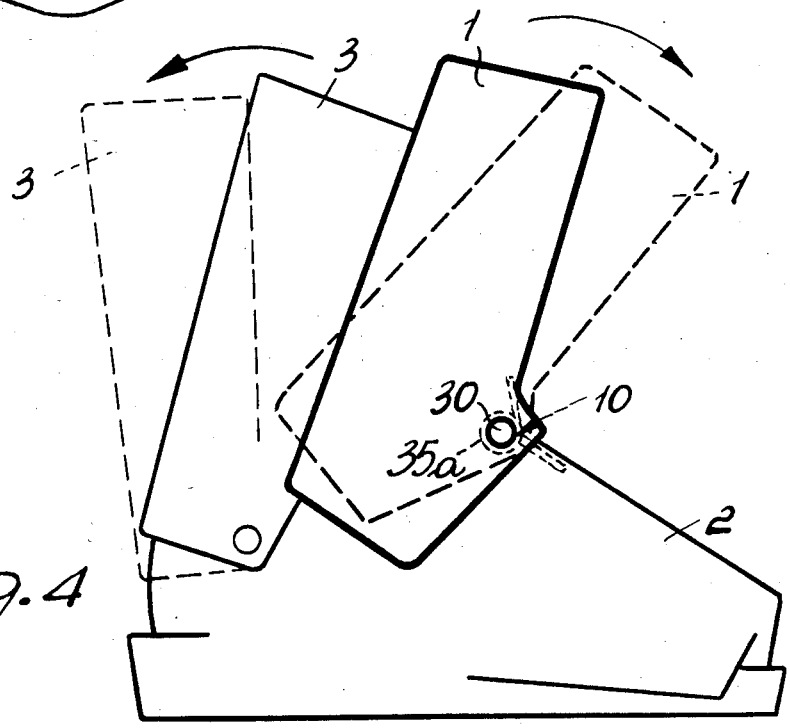
FIG. 4 is a side elevation view showing diagrammatically a ski boot.

The cited elastic means are positioned at the pivot axis, and as shown in FIGS. 1 and 4, comprise a torque pin spring 10 one end **10*a* whereof engages with the shell in abutment relationship, the other end 10*b* engaging the quarter 1** also in abutment relationship.

Figure 2:
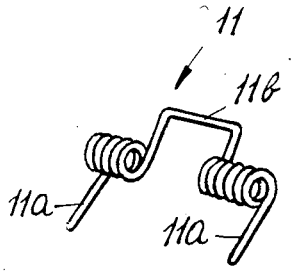
FIG. 2 shows an elastic means including a dual coil pin spring.

The elastic means, as shown in FIG. 2, may comprise a dual coil pin spring 11 which has its ends **11*a* acting against the shell and a protruding center portion 11*b*** which acts against the quarter.

Figure 3:
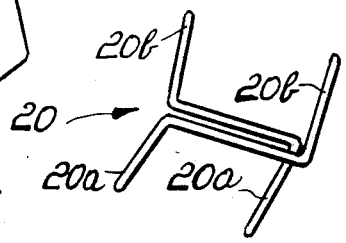
FIG. 3 shows an elastic means including square bent springs.

As shown in FIG. 3, the elastic means comprise square springs formed from two substantially Z-like torsion elements 20 which are joined together along a center portion thereof and have one of the respective ends **20*a* engaged with the shell and the other end, indicated at 20*b***, engaged with the quarter.

A further feature of the invention is that the cited elastic means are provided substantially around the pivot axis between the front quarter 1 and shell 2.

In a preferred embodiment of the invention, not to be taken as a limitation thereof, the hinge connection between the front quarter 1 and shell 2 is accomplished by means of a pair of pins 30 inserted through holes 31 formed in the shell 2 and engaging with corresponding openings **35*a* (FIG. 4) formed in lug-like protuberances 35 on the front or forward portion of the front quarter 1, the protuberances extending into the recess 2*a* with the openings 35*a* coaxial with the holes 30**.

With the arrangement just described, the quarter 1 will not practically rub, in oscillating, against the shell and its flex, i.e. its elastic bias opposed to forward oscillation or swinging, is solely determined by the characteristics inherent to the springs being used.

It may be appreciated that the elastic characteristics of the springs do not depend on external factors, nor on wear of the plastic parts which make up the boot.

Of course, the springs could be replaced with other springs having different elastic characteristics, to thus achieve different characteristic flexures which, however, would remain at all times constant irrespective of temperature and likely wear.

Another important aspect of the invention is that by having the front quarter hinged to the shell at a front upper location on the shell, increased opening of the front and rear quarters can be provided to put the boot on, since the front quarter can be spread further apart.

It may be appreciated from the foregoing that the invention achieves its objects, and in particular the fact is enhanced herein that the provision of elastic means which act on a front quarter and practically do not rub against the shell during the oscillation thereof, affords constant flex characteristics which are unaffected by wear of the parts in mutual fretting relationship or by weather conditions.

In practicing the invention, the materials used, as long as compatible with the specific intended application, and the dimensions and shapes, may be any selected ones contingent on individual requirements.

I claim:

1. Rear entrance ski boot structure comprising a shell including a front upper region, a rear quarter hinged on said shell at a distance from said front upper region and a front quarter as a separate component part of the ski boot structure and having a forward portion thereof facing said front upper region of said shell, between said forward portion and said front upper region means defining a pivot axis for said rear quarter and extending transverse to the longitudinal extension of the ski boot, said means defining a pivot axis comprising hinge formations coaxial with said pivot axis and arranged on said forward portion and said front upper region to allow swinging of said front quarter about said pivot axis and spring means opposing forward swinging movement of said quarter about said pivot axis, thereby to provide a ski boot flex constant in time.

2. Rear entrance ski boot structure comprising a shell including a front upper region, a rear quarter hinged on said shell at a distance from said front upper region and a front quarter as a separate component part of the boot structure and having a forward portion thereof facing said front upper region of said shell, said front upper region of the shell having an end portion thereof facing said forward portion and having a widthwise recess defining opposite lug formations at opposite sides of the shell, between said forward portion and said front upper region, means defining a pivot axis for said front quarter and extending transverse to the longitudinal extension of the ski boot, said means defining a pivot axis comprising through holes in said opposite lug formations coaxial with said pivot axis and hinge means for allowing swinging of said front quarter about said pivot axis, said hinge means comprising pins inserted in said through holes and lug-like protuberances projecting from said forward portion into said recess and having openings coaxial with said through holes and adapted to slidably receive said pins therein and spring means opposing forward swinging movement of said quarter about said pivot axis, thereby to provide a resistance to the forward swinging movement of the quarter, which remains unaffected by the operative conditions of the ski boot.

3. A structure according to claim 2, wherein said spring means comprise torque springs.

4. A structure according to claim 2, wherein said spring means comprise pin springs.

5. A structure according to claim 2, wherein said spring means comprise a dual coil pin spring.

6. A structure according to claim 2, wherein said spring means comprises a pair of substantially Z-like torsion members.

* * * * *